US009301609B2

(12) United States Patent
Muller et al.

(10) Patent No.: US 9,301,609 B2
(45) Date of Patent: Apr. 5, 2016

(54) PULL-OUT GUIDE FOR A FURNITURE PART WHICH CAN BE PULLED OUT OF A BASIC FURNITURE STRUCTURE

(71) Applicant: FULTERER Gesellschaft mbH, Lustenau (AT)

(72) Inventors: Wolfgang Muller, Lustenau (AT); Edwin Grubel, Widnau (DE)

(73) Assignee: FULTERER Gesellschaft mbH, Lustenau (AU)

( * ) Notice: Subject to any disclaimer, the term of this patent is extended or adjusted under 35 U.S.C. 154(b) by 96 days.

(21) Appl. No.: 14/205,646

(22) Filed: Mar. 12, 2014

(65) Prior Publication Data

US 2014/0265795 A1 Sep. 18, 2014

(30) Foreign Application Priority Data

Mar. 12, 2013 (AT) ..... A 189/2013

(51) Int. Cl.
*A47B 88/04* (2006.01)
*A47B 88/10* (2006.01)

(52) U.S. Cl.
CPC ..... *A47B 88/04* (2013.01); *A47B 88/10* (2013.01); *A47B 2210/0094* (2013.01)

(58) Field of Classification Search
CPC .... A47B 88/04; A47B 88/16; A47B 2088/04; A47B 2210/0018; A47B 88/10
USPC ..... 312/330.1, 333, 334.1, 334.7, 334.8, 312/334.11, 334.12, 334.44, 334.45, 312/334.46, 334.47; 384/18, 19, 20, 21
See application file for complete search history.

(56) References Cited

U.S. PATENT DOCUMENTS

| | | | | |
|---|---|---|---|---|
| 2004/0107536 | A1 | 6/2004 | Hollenstein | |
| 2004/0201340 | A1 * | 10/2004 | Chen et al. | 312/334.46 |
| 2005/0269922 | A1 * | 12/2005 | Lai | 312/334.46 |
| 2006/0033408 | A1 * | 2/2006 | Chiu | 312/333 |
| 2012/0014627 | A1 | 1/2012 | Rehage et al. | |

FOREIGN PATENT DOCUMENTS

| | | |
|---|---|---|
| AT | 391603 | 11/1990 |
| AT | 392883 | 6/1991 |
| AT | 512897 | 12/2013 |
| DE | 202008006755 | 11/2009 |
| DE | 202009001963 | 9/2010 |
| EP | 0868866 | 10/1998 |
| EP | 1360914 | 11/2003 |
| EP | 1561398 | 8/2005 |

(Continued)

*Primary Examiner* — James O Hansen
(74) *Attorney, Agent, or Firm* — Volpe and Koenig, P.C.

(57) ABSTRACT

A pull-out guide for a furniture part which is pulled out of a basic furniture structure having first and second guide rails, the second guide rail is mounted for displacement over a displacement distance, in and counter to a displacement direction. A braking action of the second guide rail is damped at least at one end of the displacement distance by a stop damper against which a mating stop element runs up. The stop damper includes a lever mounted for pivoting about a pivot axis on the guide rail on which the stop damper is arranged, and has first and second lever arms which can be flexed elastically for damping the braking action of the second guide rail. At a limit value for the pivoting action of the first lever arm, an overload-stop device takes effect and limits the pivoting action of the first lever arm about the pivot axis.

17 Claims, 11 Drawing Sheets

(56) References Cited

FOREIGN PATENT DOCUMENTS

| | | |
|---|---|---|
| EP | 1817984 | 8/2007 |
| EP | 1795088 | 2/2012 |
| GB | 2449915 | 12/2008 |
| WO | 2012152893 | 11/2012 |

* cited by examiner 4
8
10
11
13
21
23
22
20
26
44
45
9
30
58
27
39
28
25
31
29
12
69
62
56
57
47
55
54
52
49
50
51
61
G
H
50
56
FE

PULL-OUT GUIDE FOR A FURNITURE PART WHICH CAN BE PULLED OUT OF A BASIC FURNITURE STRUCTURE

INCORPORATION BY REFERENCE

The following documents are incorporated herein by reference as if fully set forth: Austrian Patent Application No. A 189/2013, filed Mar. 12, 2013.

BACKGROUND

The invention relates to a pull-out guide for a furniture part which can be pulled out of a basic furniture structure, comprising a first guide rail and a second guide rail, which is mounted such that it can be displaced over a displacement distance, in and counter to a displacement direction, in relation to the first guide rail, wherein the braking action of the second guide rail is damped at least at one end of the displacement distance by a stop damper, which is arranged on one of the guide rails and against which a mating stop element, which is arranged on the other guide rail, runs up.

It is known to provide damping devices for pull-out guides for pull-out furniture parts, in particular drawers or pull-out cabinet units, these damping devices damp braking action at least at one end of the displacement distance. It is known to have, for example, linear dampers in the form of piston/cylinder units and rotation dampers, which damp the pushing-in action of the guide rail over a final part of the displacement distance, wherein such damping devices are often combined with self-retracting means. A disadvantage of such cylinder dampers or rotation dampers is in the amount of space required. Installation in the pull-out guides is not possible in the case of many embodiments of pull-out guides, and arrangement outside the pull-out guide is often problematic. In addition, such cylinder dampers or rotation dampers render the pull-out guide more expensive.

It is also known to use elements made of elastomer materials, in particular rubber elements on parts which run up against one another. The design, however, often means that the stop surfaces which run up against one another are relatively small, and it is precisely in the case of pull-out guides which are designed for a relatively high load-bearing force that such rubber stop elements, during operation, wear relatively quickly.

It is known to have pull-out guides, for example, in the form of roller-type pull-out guides in which the running rollers serving for displacement purposes are mounted on the rail such that they can be rotated about pins which are fixed in location in relation to said rails. Roller-type pull-out guides based on differential construction have a load-transmitting differential roller which is mounted in a rotatable manner on the center rail, which results in the rails running synchronously or differentially. The center rail here covers in each case only half the distance of the pull-out rail in relation to the basic-structure rail. Such roller-type differential pull-out guides are known, for example, from AT 391 603 B and EP 1 360 914 A1.

A further kind of roller-type pull-out guide is known in the form of telescopic pull-out guides in which load-transmitting running rollers are mounted in a rotatable manner on all the rails and in which the pull-out rail and the center rail are pulled one after the other out of the basic-structure rail. In order for the guide rails to be pulled out simultaneously, it is also known to use, on the center rail, an elastic driver roller which is mounted in a rotatable manner and passes through a window aperture of the center rail, but does not perform any load-transmitting function. Such a telescopic pull-out guide with differential action is described, for example, in AT 392 883 B.

In addition to roller-type pull-out guides, pull-out guides which have carriages provided with rolling-contact bodies, e.g. ball-type pull-out guides, are also known. A ball-type telescopic pull-out guide can be gathered, for example, from EP 1 561 398 A1.

SUMMARY

It is an object of the invention to provide a pull-out guide of the type mentioned in the introduction which has an advantageous damping device which can be integrated in the pull-out guide with only a relatively small amount of space being required, wherein it is possible to realize a durable damping device even for pull-out guides provided for relatively high loads. This is achieved by a pull-out guide according to the invention.

For the pull-out guide according to the invention, use is made of a stop damper which is designed in the form of a lever. This lever is mounted for pivoting about a pivot axis on the first guide rail, in relation to which the second guide rail, which can be braked, is mounted in a displaceable manner, or on the second guide rail, which can be braked. A mating stop element is arranged on the other of the two guide rails. The lever has a first lever arm with a stop surface, against which the mating stop element runs up for braking the second guide rail, and a second lever arm with a supporting surface by which the second lever arm is supported in relation to that guide rail on which the lever is mounted for pivoting about the pivot axis. The second lever arm is of elastically flexible design such that the second lever arm uses its flexing to damp the braking action of the second guide rail. The second lever arm thus acts in the manner of a leaf spring. The first lever arm here is preferably not flexible, or is at least much less flexible (by a factor of at least 5), and therefore the first lever arm contributes much less, or nothing at all, to damping the braking action of the second guide rail. Also present is an overload-stop device. If the first lever arm, during the braking action of the second guide rail, is pivoted to an increasing extent from a starting position, which assumes when the mating stop element is spaced apart from the stop surface, then the overload-stop device takes effect when a limit value for the pivoting action of the first lever arm about the pivot axis is reached. This overload-stop device limits the pivoting action of the first lever arm about the pivot axis to a maximum value, and therefore this overload-stop device limits the force to which the second lever arm is subjected by the mating stop element. The overload-stop device thus takes effect when a maximum flexing action of the second lever arm is achieved, and prevents any further flexing of the second lever arm.

It is preferably possible for the stop surface of the first lever arm to be moved, solely as a result of the flexing of the second lever arm, over a distance, as seen in the displacement direction of the second guide rail in relation to the first guide rail, of at least 1 mm, preferably at least 2 mm, before the overload-stop device takes effect.

The overload-stop device is, in particular, a fixed stop. It is therefore the case that two non-flexible elements, preferably made of metal, run up against one another.

The pull-out guide according to the invention has at least one such damping device acting in a displacement direction, at the end of the displacement distance, between two guide rails of the pull-out guide. A pull-out guide according to the invention may also have two or more such damping devices, wherein a respective damping device acts in a respective displacement direction between two respective guide rails. If such damping devices are present in both displacement directions for two guide rails which can be displaced in relation to one another, then these damping devices advantageously share some parts, e.g. have a common stop damper in the form of a lever, wherein separate mating stop elements are present for the two displacement directions, said mating stop elements pivoting the first lever arm in opposite respective displacement directions at the end of the displacement distance, in which case the second lever arm is flexed in opposite directions.

In one possible embodiment, the overload-stop device of a damping device according to the invention may comprise the mating stop element and an end stop, which is arranged on that guide rail on which the stop damper is mounted in a pivotable manner. If the first lever arm, by virtue of the mating stop element running up against it, is pivoted about the pivot axis until the limit value for the pivoting action has been reached, the mating stop element runs up against the end stop. It is advantageously possible here for the end stop to be arranged in an interspace between two limbs of the first lever arm. This makes it possible to achieve central loading of the mating stop element, and therefore no tilting moments occur.

In another possible embodiment, it is possible for the overload-stop device to have a first overload-stop element, which is arranged on the first guide rail and interacts with a second overload-stop element, which is arranged on the second guide rail. The first and second overload-stop elements here are parts which are separate from the mating stop element and from the stop damper. For example, they may be formed by tabs which are bent out of the guide rails.

A limit value of the force to which the stop damper is subjected by the mating stop element, the overload-stop device taking effect when said force is exceeded, ranges, for example, from 150 to 300 N.

The length of the second lever arm as measured along the course of the longitudinal extent of the second lever arm from the pivot axis to the supporting surface (that is to say the length measured along the neutral axis), also possibly referred to as the developed length or effective length of the second lever arm, is advantageously at least three times the length of the first lever arm as measured along the course of the longitudinal extent of the first lever arm from the pivot axis to the stop surface (that is to say the length measured along a neutral axis), also possibly referred to as the developed length or effective length of the first lever arm. If a second lever arm takes a rectilinear course, the developed length thus corresponds to the distance between the supporting surface and the pivot axis. If the first lever arm takes a rectilinear course, the developed length of the first lever arm thus corresponds to the distance between the stop surface and the pivot axis. For the course taken by the respective lever arm, use is made of a neutral axis thereof.

The second lever arm runs, preferably at least over a part of its longitudinal extent, at an angle of less than 45° to the displacement direction of the second guide rail in relation to the first guide rail. This part of the longitudinal extent is at least the predominant part of the entire longitudinal extent (=the developed or effective length) of the second lever arm.

A damping device designed in the manner described above can advantageously be integrated in the pull-out guide.

An advantageous embodiment provides that, as seen in a side view in the direction of the pivot axis, a first straight connecting line, which runs between the stop surface of the first lever arm and the pivot axis, encloses an angle of less than 135°, preferably less than 110°, with a second straight connecting line, which runs between the supporting surface of the second lever arm and the pivot axis. This angle particularly preferably ranges from 70° to 90°.

The lever forming the stop damper preferably has a main material which is a plastic material which has a modulus of elasticity ranging from 6,000 to 30,000, preferably 10,000 to 25,000, wherein a value ranging from 15,000 to 20,000 is particularly preferred. It is possible here for a relatively small fraction of other materials, of preferably less than 10% by volume of the entire stop damper, to be present or it is possible for the stop damper to be formed overall entirely of this main material, i.e. not to have any other materials. The main material advantageously has a tensile and compressive strength of more than 100 megapascals, preferably more than 150 megapascals.

The main material is preferably a plastic material filled with strength-enhancing fillers. Examples of filler materials which may be used are glass fibers, aramid fibers, carbon fibers, or glass balls. The filler content advantageously ranges from 20% to 60%. The plastic material may be, for example, polyamide, PEEK or polyamide imide.

Wherever this document refers to "front"/"forward" and "rear"/"rearward", these terms refer to the pulling-out displacement direction of the pull-out guide.

BRIEF DESCRIPTION OF THE DRAWINGS

Further advantages and details of the invention will be explained hereinbelow with reference to the accompanying drawing, in which.

DETAILED DESCRIPTION OF THE PREFERRED EMBODIMENTS

Figure 8:
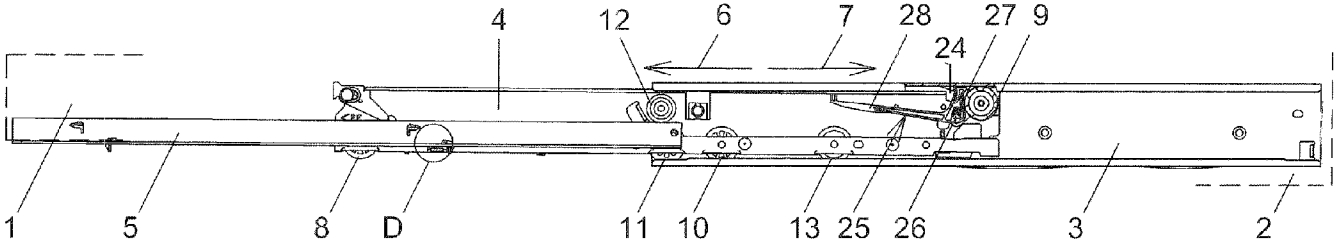
FIG. 8 shows an elevation view of the pull-out guide in the pulled-out state.
Figure 7:
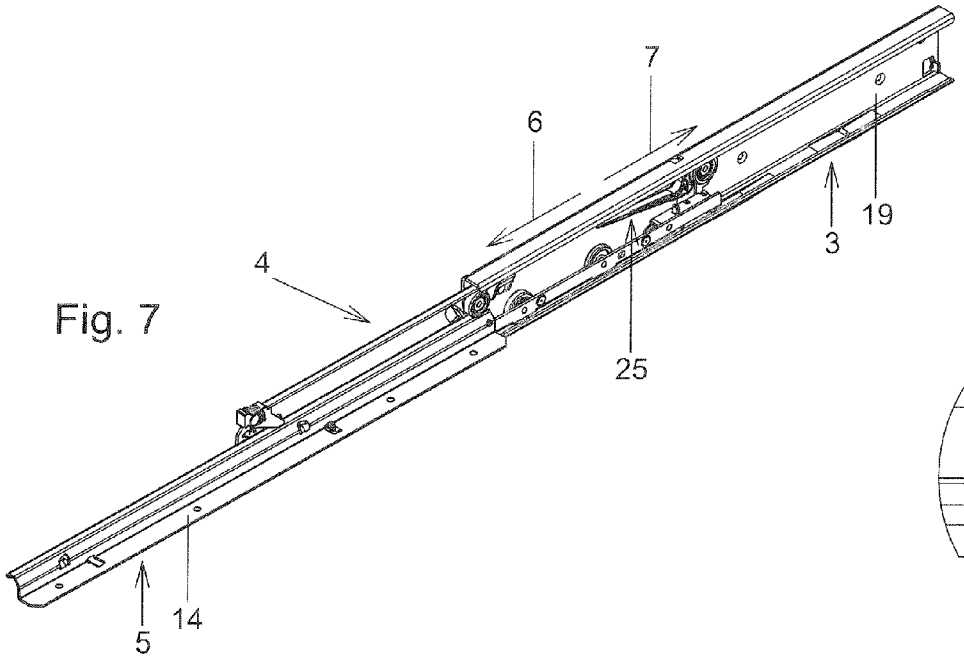
FIG. 7 shows an perspective view of the pull-out guide in the pulled-out state.

FIGS. 1 to 35 illustrate an exemplary embodiment of a pull-out guide designed in the manner according to the invention. The pull-out guide serves for pulling a pull-out furniture part 1 out of a basic furniture structure 2, indicated only in FIG. 8, by dashed lines. The pull-out furniture part 1 indicated is a drawer. A pull-out guide according to the invention may, for example, also be designed for pulling out pull-out cabinet units.

Such pull-out guides are fitted on either side of the pull-out furniture part 1, only one pull-out guide being illustrated and the two being of mirror-inverted design.

It is advantageously possible for a pull-out guide according to the invention to be designed for relatively high load-bearing forces. In particular it is possible for the load-bearing force of the pull-out guides arranged on either side of the pull-out furniture part together to be more than 100 kg.

In the exemplary embodiment shown, the pull-out guide comprises a basic-structure-mounted guide rail 3, for fitting on the basic furniture structure 2, a central guide rail 4 and a pull-out guide rail 5, for fitting on the pull-out furniture part 1. The guide rails 3 and 4 and the guide rails 4 and 5 are mounted such that they can be displaced in relation to one another in each case.

In order for the rails 3, 4, 5 to be mounted such that they can be displaced in relation to one another, in the exemplary embodiment shown, all the running rollers are mounted in a rotatable manner on the central guide rail 4. This forms, in a known manner, a differential pull-out mechanism in which, when the pull-out guide rail 5 is pulled out, the central guide rail 4 moves at half the speed of the pull-out guide rail 5.

The running rollers comprise a front running roller 8, which is mounted such that it can be rotated in the region of the front end of the guide rail 4, as seen in the pulling-out displacement direction 6, a rear running roller 9, which is mounted such that it can be rotated in the region of the rear end of the guide rail 4, a central running roller 10, which is mounted such that it can be rotated in a central region of the guide rail 4, a differential roller 11, which is mounted such that it can be rotated with play, and is arranged alongside the central running roller 10, and a supporting roller 12, which is mounted such that it can be rotated above the differential roller 11. Also advantageously present is an auxiliary roller 13, which is mounted such that it can be rotated with play in a region of the longitudinal extent of the central guide rail 4 which is located between the rear running roller 9 and the central running roller 10.

The pull-out guide rail 5 comprises a supporting crosspiece 14 for supporting the pull-out furniture part 1, a running crosspiece 15 and a connecting crosspiece 16, which connects the supporting crosspiece to the running crosspiece 15. The running crosspiece 15 has, on its underside, a runway for the front running roller 8 and the differential roller 11 and, on its upper side, a runway for the supporting roller 12. It would also be possible for the supporting crosspiece 14 to be dispensed with and for the connection to the pull-out furniture part 1 to take place via the connecting crosspiece 16.

The basic-structure-mounted guide rail 3 comprises an upper running crosspiece 17 and a lower running crosspiece 18, which are connected to one another by a connecting crosspiece 19. The upper running crosspiece 17 has, on its underside, a runway for the rear running roller 9. The lower running crosspiece 18 has, on its upper side, a runway for the differential roller 11, the central running roller 10 and the auxiliary roller 13.

It is preferable for the rollers 8-13 to be mounted such that they can be rotated about horizontal pins and for the running crosspieces 15, 17 and 18 to be oriented horizontally.

The rear guide rail has a vertical crosspiece 20, from which an upper and a lower horizontal crosspiece 23, 21 extend at the upper and the lower ends. The lower horizontal crosspiece 23 is provided with an upwardly directed flange 22 running parallel to the vertical crosspiece 20. The rear running roller 9 and supporting roller 12 are mounted such that they can be rotated about pins secured on the vertical crosspiece 20. The front running roller 8, central roller 10, differential roller 11 and auxiliary roller 13 are mounted such that they can be rotated about pins which run between the vertical crosspiece 20 and the flange 22.

Instead of being in the form of a differential pull-out mechanism, which has a load-transmitting differential roller 11 mounted in a rotatable manner on the center rail, it would also be possible for the mounting of the guide rails 3, 4, 5 such that they can be displaced in relation to one another to take place in some other way, for example by way of a differently designed roller-type pull-out mechanism in which the guide rails can be displaced in relation to one another by way of running rollers, wherein the running rollers are mounted such that they can be rotated about pins which are at a fixed location in relation to the relevant guide rails. Another example of such a roller-type pull-out guide is a telescopic pull-out mechanism, in which running rollers are mounted in a rotatable manner on all the guide rails and the guide rails are pulled out one after the other. The invention can also be used for types of pull-out guides other than roller-type pull-out guides with running rollers having pins which are fixed in location in relation to the guide rails, in particular for pull-out guides which have carriages provided with rolling-contact bodies, e.g. ball-type pull-out guides.

The displaceability of the central guide rail 4 in relation to the basic-structure-mounted guide rail 3 and of the pull-out guide rail 5 in relation to the central guide rail 4 is limited by the stops in each case in the pulling-out displacement direction 6 and in the opposite, pushing-in displacement direction 7, wherein the rails can be displaced in relation to one another in each case over a displacement distance between the stops.

If the central guide rail 4 is displaced in the pulling-out displacement direction 6 in relation to the basic-structure-mounted guide rail 3, then, at the end of the displacement distance in the pulling-out displacement direction, a mating stop element 24, which is arranged on the basic-structure-mounted guide rail 3, runs up against a rear stop damper 25, which is arranged on the central guide rail 4. The mating stop element 24 here is formed by a tab which is punched out of the upper horizontal crosspiece 23 and bent down, but it could also be formed in some other way.

The rear stop damper 25 is designed in the form of a two-armed lever and is mounted for rotation about a horizontal pivot axis 26 on the central guide rail 4. The first lever arm 27 interacts with the mating stop element 24, and the second lever arm 28 is supported, via a supporting surface 29, on the central guide rail 4, in the exemplary embodiment on the underside of the upper horizontal crosspiece 23. The upper horizontal crosspiece 23 here has a slot-like through-passage 30, in which engages a stub 31 which projects beyond the supporting surface 29 and belongs to the second lever arm 28, this resulting in a formation of a guide for the end of the second lever arm 28 in the displacement direction 6. The Figures illustrate the rear stop damper 25 in the state in which it has been relieved of stressing. It is actually the case that the stop damper, when installed in the central guide rail, is pre-stressed to some extent. The end of the second lever arm 28 is therefore not illustrated in its correct position in the Figures, cf. in particular, FIGS. 23 and 29. In the actually installed, pre-stressed and therefore slightly flexed state of the rear stop damper, the supporting surface 29, as has been said, butts against the underside of the upper horizontal crosspiece 23 and the stub 31 projects into the through-passage 30.

It would also be possible for the end of the second lever arm 28 to be supported in some other way on the guide rail 4, on which the stop damper 25 is mounted in a rotatable manner, for example this could be done via a part fitted on the profile of the guide rail 4.

In order to install the rear stop damper 25 on the central guide rail 4, an axial stub 32 with a protrusion 33 projected downward beyond it (cf. FIG. 33) is pushed into a keyhole-like opening 34 (cf. FIG. 30) and guided downward until the protrusion 33 engages over the periphery of the opening 34. An extension arranged at the upper end of the vertical cross-piece 20 of the central guide rail 4 here is pushed in through an opening 35 in the first lever arm 27 (cf. FIG. 35). The front end surface of said extension forms an end stop 36, as will be described hereinbelow. This end stop is located between the side limbs 37, 38 of the first lever arm 27.

The second lever arm 28 has a central region of its longitudinal extent guided in relation to the guide rail 4, since a stub 67 arranged on the second lever arm 28 (cf. FIGS. 32 and 34) engages in a slot 68 (cf. FIGS. 2 and 30) in the guide rail 4.

The first lever arm 27 has stop lugs 39, 40 spaced apart from a basic part of the first lever arm 27 by a slot. These stop lugs each have a stop sub-surface, against which the mating stop element 24 runs up at the end of the pull-out distance. These stop sub-surfaces together form a stop surface 41 of the first lever arm 27 for interacting with the mating stop element 24.

Figure 9:
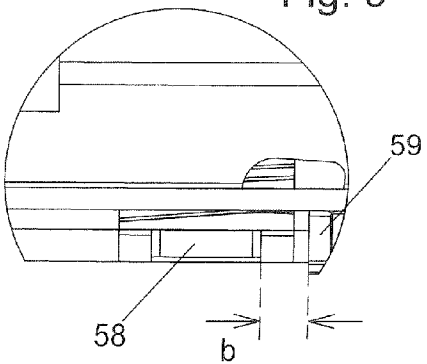
FIG. 9 shows an enlarged detail D from FIG. 8.
Figure 10:
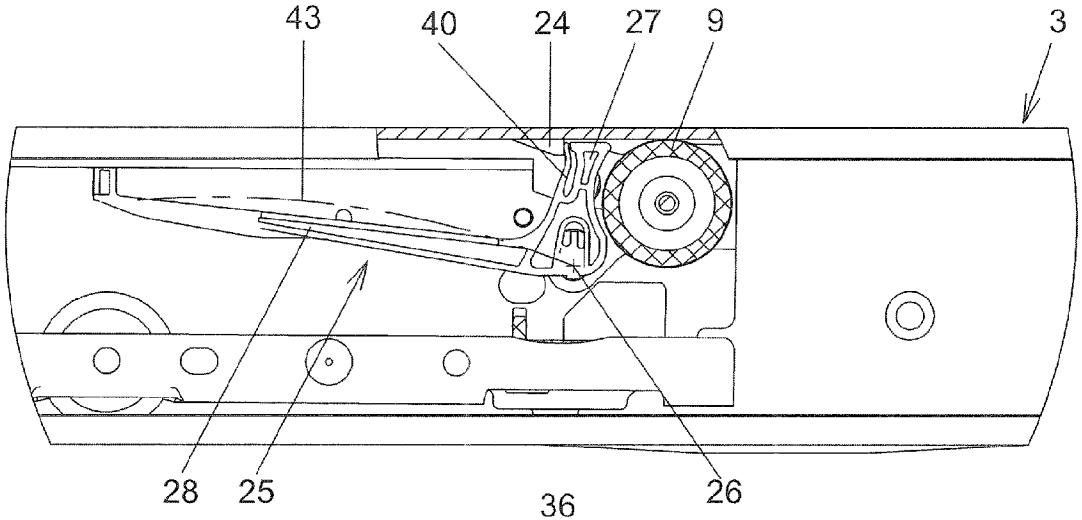
FIG. 10 shows an enlarged part of the elevation view from FIG. 8 in the region of the rear stop damper.
Figure 11:
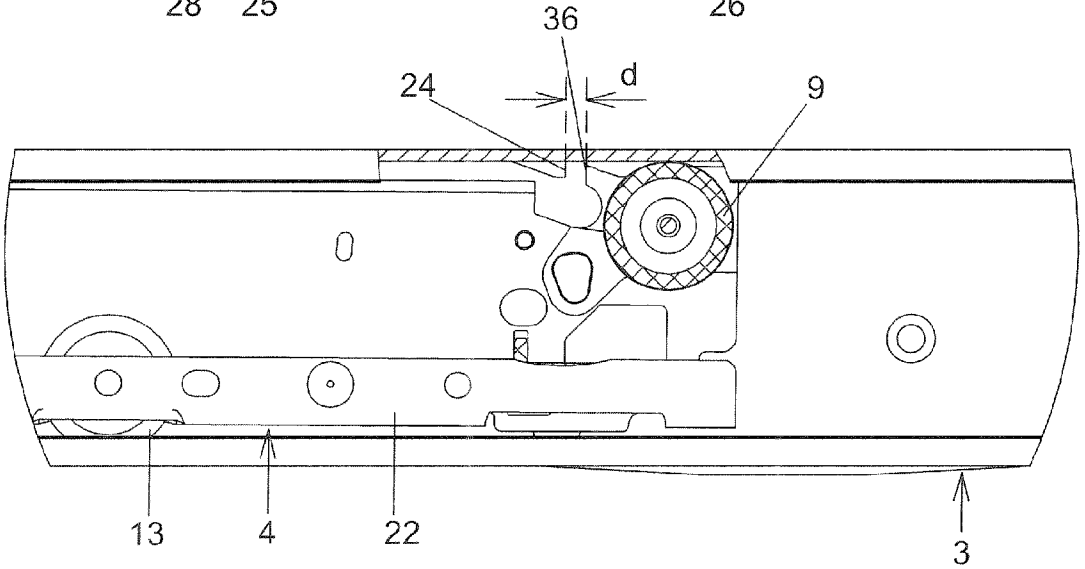
FIG. 11 shows an elevation view corresponding to FIG. 10, with the rear stop damper omitted.
Figure 12:
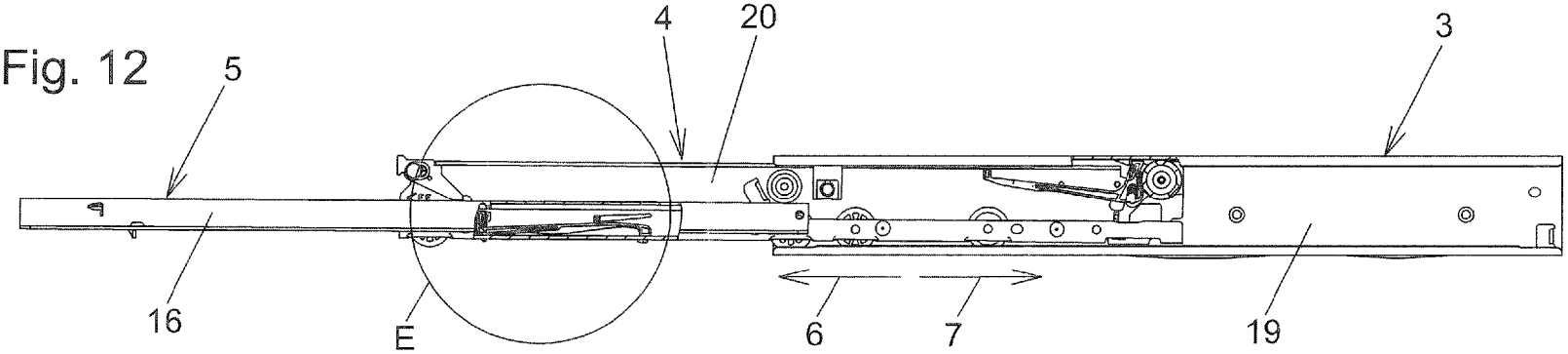
FIG. 12 shows an elevation view corresponding to FIG. 8, illustrating the pull-out guide rail in a partially broken-away state in the region of the front stop damper.
Figure 13:
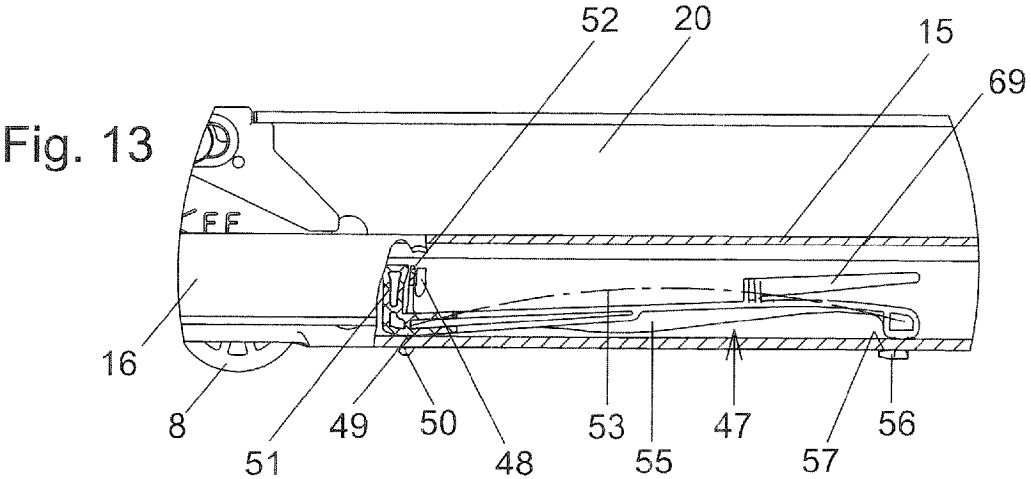
FIG. 13 shows an enlarged detail E from FIG. 12.
Figure 15:
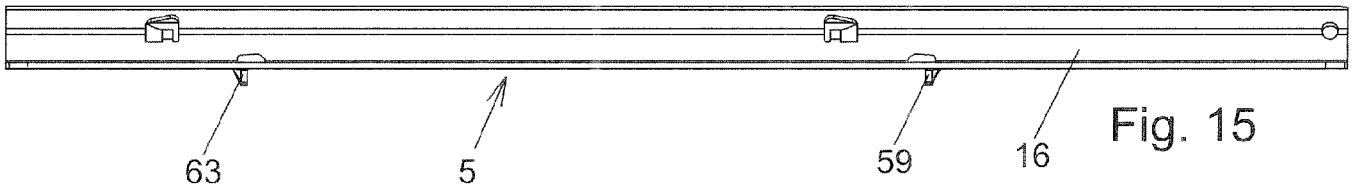
FIG. 15 shows an elevation view of the pull-out guide rail.
Figure 14:
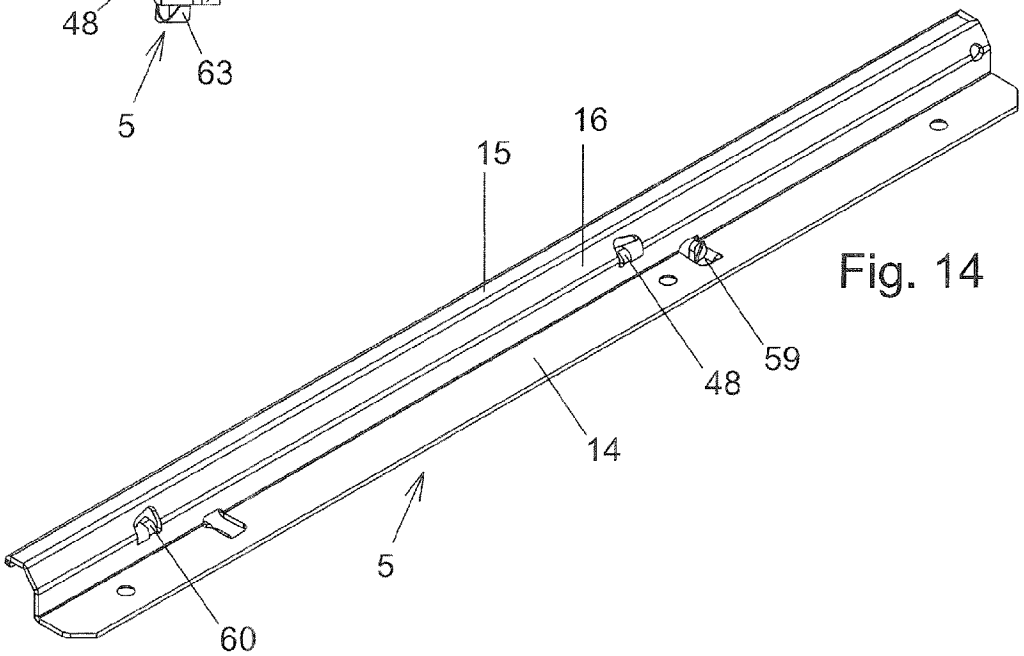
FIG. 14 shows an perspective view of the pull-out guide rail.
Figure 16:
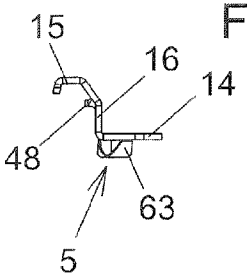
FIGS. 16 and 17 show front and rear end elevation views of the pull-out guide rail.
Figure 17:
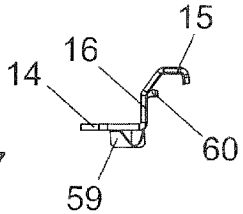
Figure 19:
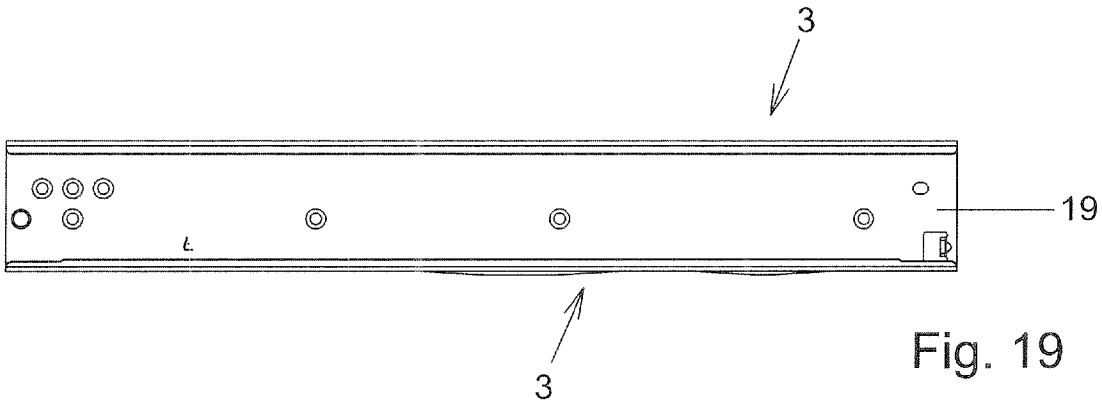
FIG. 19 shows an elevation view of the basic-structure-mounted guide rail.
Figure 18:
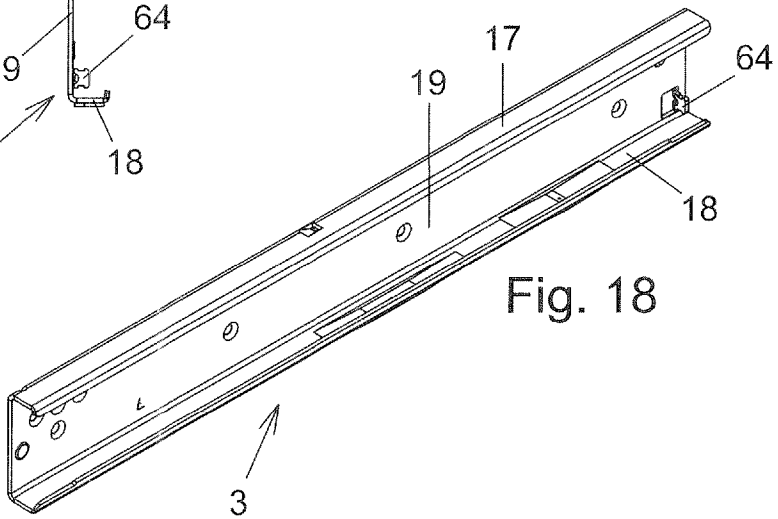
FIG. 18 shows an perspective view of the basic-structure-mounted guide rail.
Figure 20:
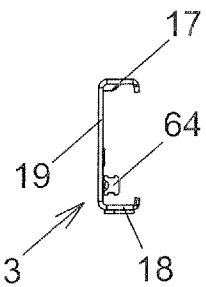
FIGS. 20 and 21 show front and rear end elevation views of the basic-structure-mounted guide rail.
Figure 21:
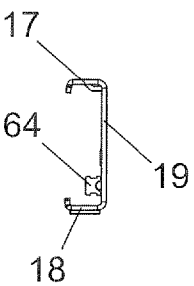
Figure 22:
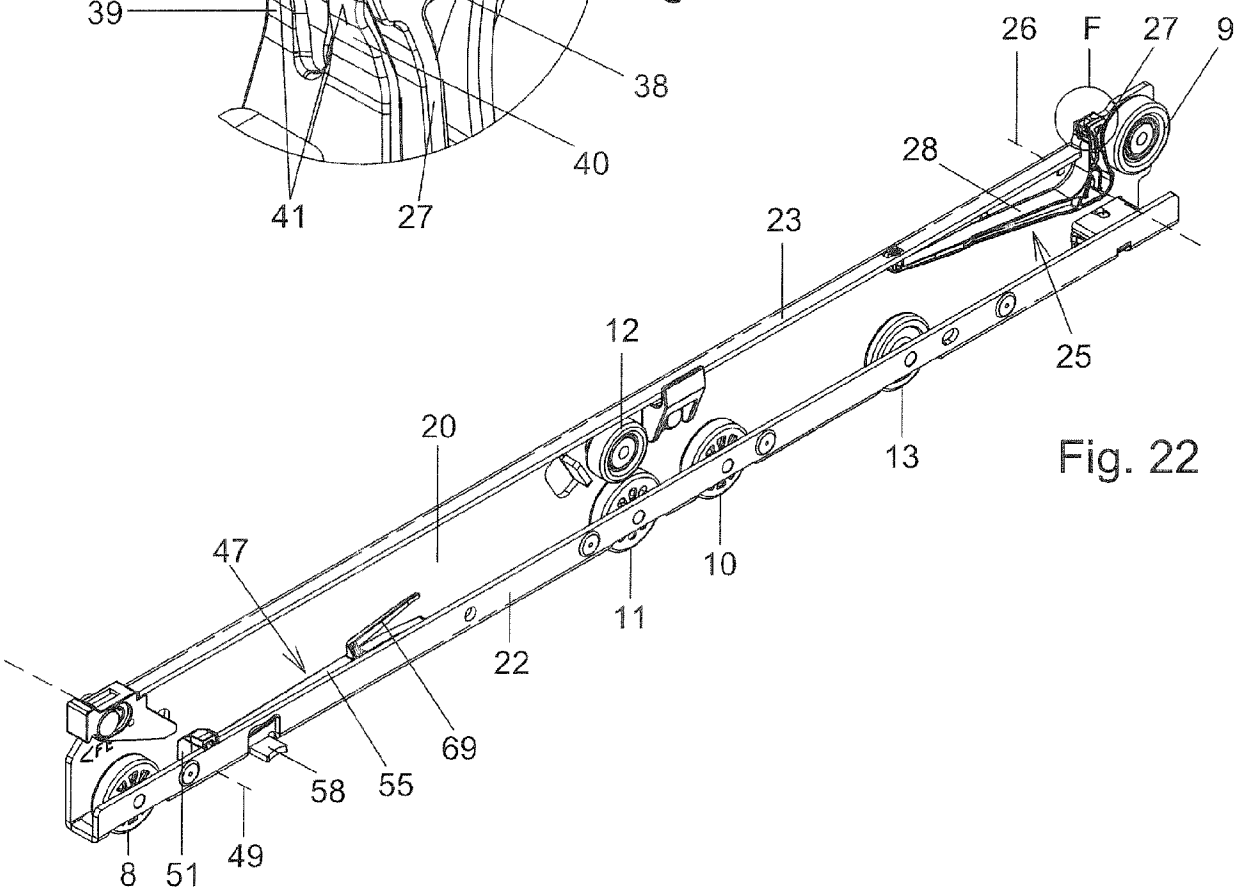
FIG. 22 shows an perspective view of the central guide rail.
Figure 26:
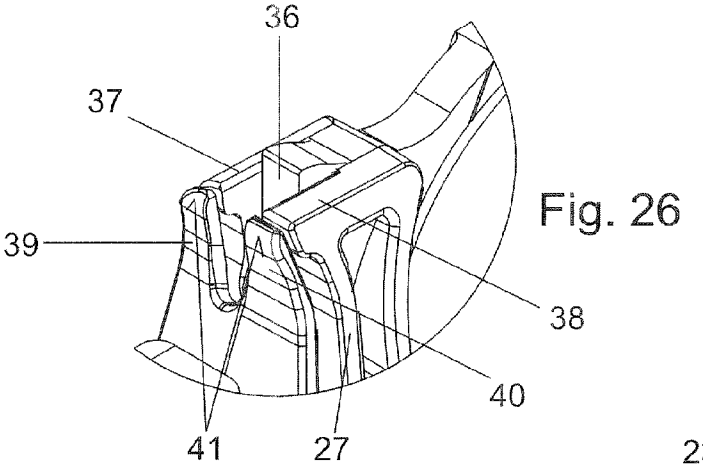
FIG. 26 shows an enlarged detail F from FIG. 22.
Figure 28:
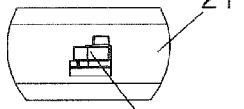
FIG. 28 shows an enlarged detail H from FIG. 24.
Figure 27:
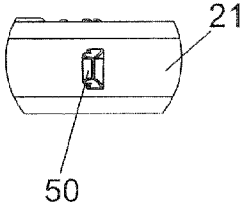
FIG. 27 shows an enlarged detail G from FIG. 24.

FIGS. 7 to 13 show the central guide rail 4 in the position in which the mating stop element 24, during displacement of the pull-out guide in the displacement direction 6, is just running up against the stop surface 41 of the first lever arm 27 of the rear stop damper 25. From this position, the rear stop damper 25 takes effect. In the first instance, the stop lugs 39, 40 are bent in the direction of the basic part of the first lever arm 27, until they are butting against an abutment surface 42 of the basic part of the first lever arm 27. This closes the gap between the stop lugs 39, 40 and the basic part of the first lever arm 27. As a result, the first lever arm 27 is pivoted about the pivot axis 26, wherein the second lever arm 28 flexes to an increasing extent. This flexing is indicated in FIG. 10 by a dashed line 43 (the line 43 may be considered to be the neutral axis in the flexed state of the second lever arm 28). Flexing thus takes place about an imaginary flexing axis located parallel to the pivot axis 26.

The first lever arm 27 here is at least essentially rigid. The first lever arm 27 as a whole, i.e. the basic part thereof does not flex at all, or at least does so to a much lesser extent than the second lever arm 28. It is at least the case that the spring rate of the flexing of the second lever arm 28 is less than 10% of the spring rate of the flexing of the basic part of the first lever arm 27.

The stop lugs 39, 40, in contrast, can be flexed much more easily than the second lever arm 28. Flexing of the stop lugs 39, 40 until the latter are butting against the abutment surface 42 therefore results in barely any flexing of the second lever arm 28. The spring rate of the flexing of the stop lugs 39, 40 is preferably less than 10% of the spring rate of the flexing of the second lever arm.

The stop lugs 39, 40 result in the stopping noise of the mating stop element 24 against the rear stop damper 25 being reduced to a considerable extent. It is also conceivable and possible, however, for the stop lugs 39, 40 to be dispensed with or for just one stop lug to be present.

Also present is an overload-stop device, which takes effect when a limit value for the pivoting action of the first lever arm 27 from the starting position of the latter (the first lever arm 27 assuming this position as long as the mating stop element 24 is spaced apart from the stop surface 41) is reached. This overload-stop device here comprises the mating stop element 24 and the end stop 36. In particular FIG. 11, in which the rear stop damper 25 is blanked out, shows that the mating stop element 24 and the end stop 36 are spaced apart by a distance d at the moment when the mating stop element 24 runs up against the stop surface 41. As the stop lugs 39, 40, if present, flex to an increasing extent, and then as the first lever arm 27 pivots, and the second lever arm 28 flexes, to an increasing extent, the distance a decreases until, at the limit value for the pivoting action of the first lever arm 27, the mating stop element 24 runs up against the end stop 36. This means that the damping distance for the braking action of the central guide rail 4 in relation to the basic-structure-mounted guide rail 3 has been covered in full, and any further displacement of the central guide rail 4 in relation to the basic-structure-mounted guide rail 3 in the pulling-out displacement direction 6, and thus any further pivoting of the first lever arm 27 about the pivot axis 26, is blocked. This prevents any possible overloading of the rear stop damper 25.

From the moment at which the mating stop element 24 runs up against the stop surface 41 until the overload-stop device takes effect, it is therefore the case, in the first instance, that the at least one stop lug 39, 40, if present, flexes until it is butting against the stop surface 42. The distance which the mating stop element 24 covers here in the displacement direction 6 preferably ranges from 0.2 mm to 1 mm, particularly preferably ranges from 0.3 mm to 0.6 mm. It is also possible for the mating stop element 24, until the overload-stop device takes effect, to cover a distance in the displacement direction 6 which is made possible by the second lever arm 28 flexing to an increasing extent. It is preferably provided that it is solely as a result of the flexing of the second lever arm 28 that the mating stop element 24 can cover a distance in the displacement direction 6 which ranges from 1 mm to 7 mm, preferably ranges from 1.5 mm to 5 mm, particularly preferably ranges from 3 mm to 4 mm. It is also therefore the case that the stop surface 41 can be displaced by this distance in the displacement direction 6 only on account of said flexing of the second lever arm 28.

In the exemplary embodiment, the rear stop damper 25 is made in one piece from a filler-containing plastic material.

In this exemplary embodiment, the second lever arm 28, as long as the mating stop element 24 is spaced apart from the stop surface 41, extends rectilinearly, with the exception of a relatively short end part adjoining the supporting surface 29. It is also conceivable and possible to have a more or less bent embodiment and/or an at least largely folded embodiment (in which the second lever arm 28 has two or more parts with bends of more or less 90° between them). In the exemplary embodiment, the first lever arm 27 is likewise of essentially rectilinear design. A more or less bent or even folded embodiment would also be conceivable and possible, in principle, here.

The length of the second lever arm 28 as measured along the course of the longitudinal extent of the second lever arm 28 from the pivot axis 26 to the supporting surface 29 is at least three times the length of the first lever arm as measured along the course of the longitudinal extent of the first lever arm 27 from the pivot axis 26 to the stop surface 41. This provides for an advantageous length of the second lever arm 28 for the flexing thereof.

Figures 23, 24, 25, 29:
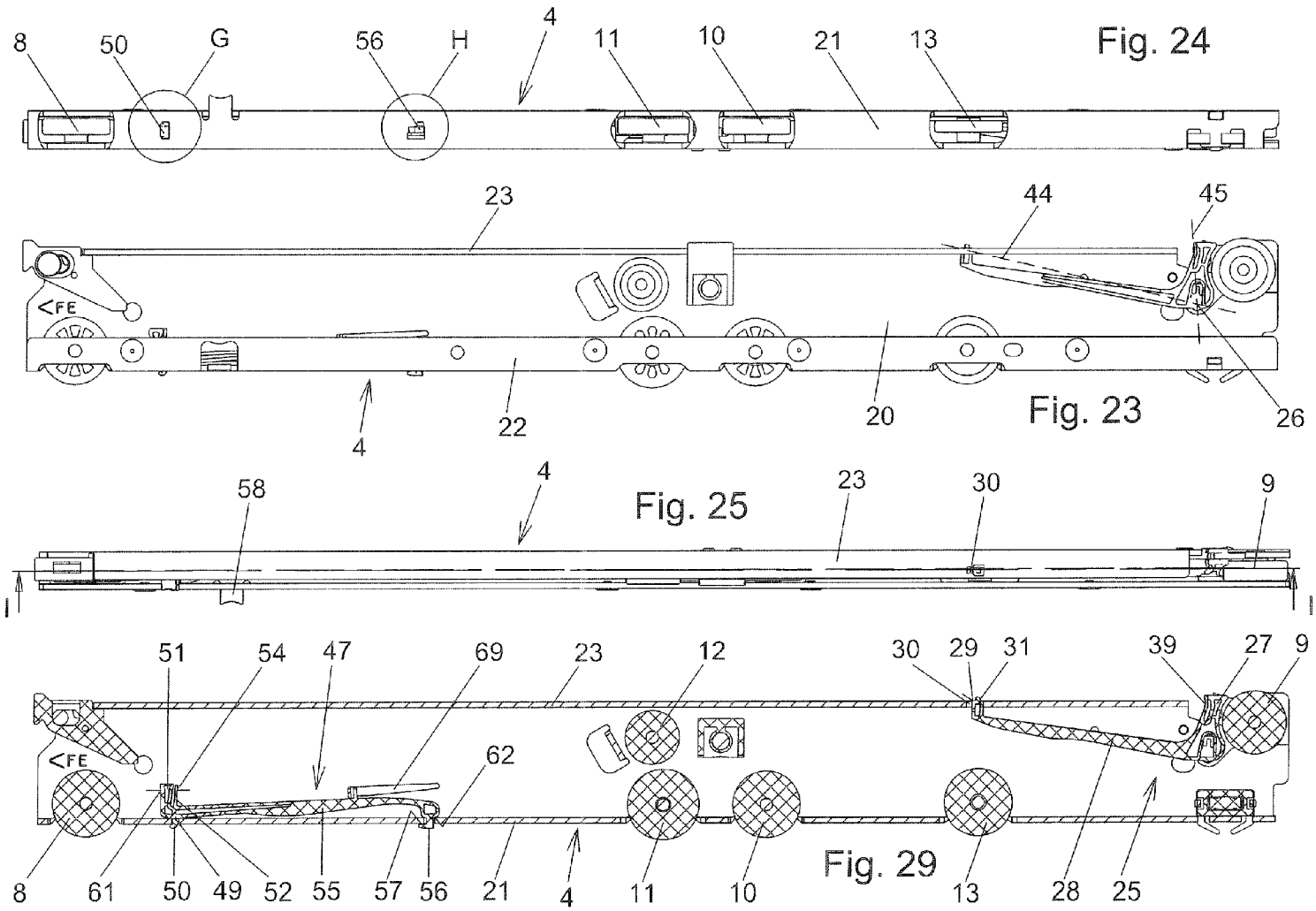
FIG. 23 shows an elevation view of the central guide rail.
FIG. 24 shows a bottom view of the central guide rail.
FIG. 25 shows a plan view of the central guide rail.
FIG. 29 shows a section taken along line II from FIG. 25.
Figure 30:
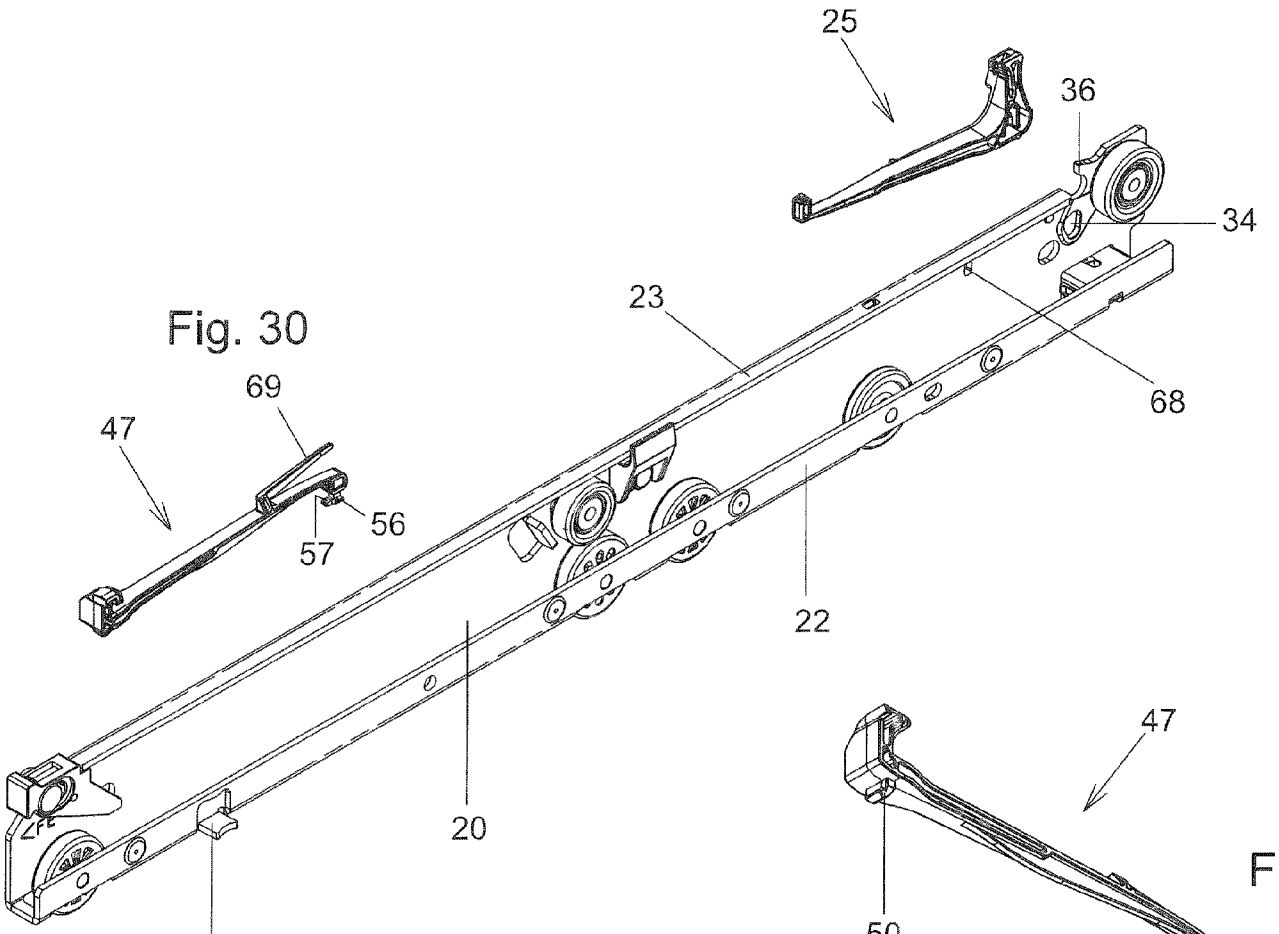
FIG. 30 shows an perspective view of the central guide rail with the front and rear stop dampers removed in the manner of an exploded illustration.
Figure 31:
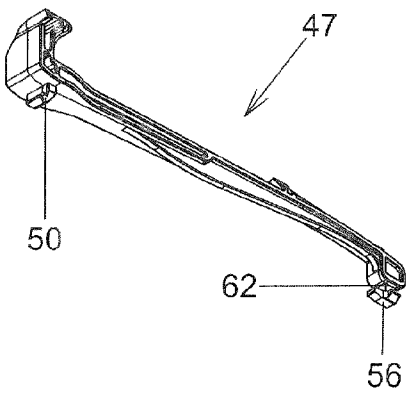
FIG. 31 shows an perspective view of the front stop damper from a different viewing angle in relation to FIG. 30.
Figure 34:
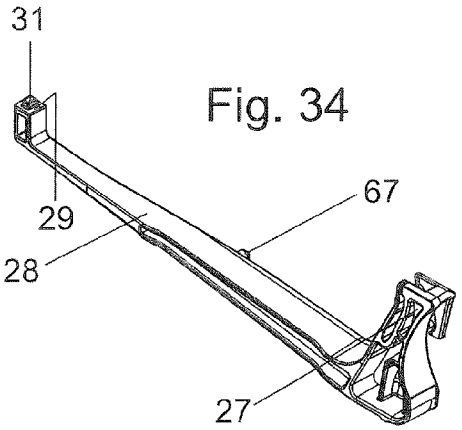
FIGS. 32 to 34 show perspective views of the rear stop damper from different viewing angles.
Figure 35:
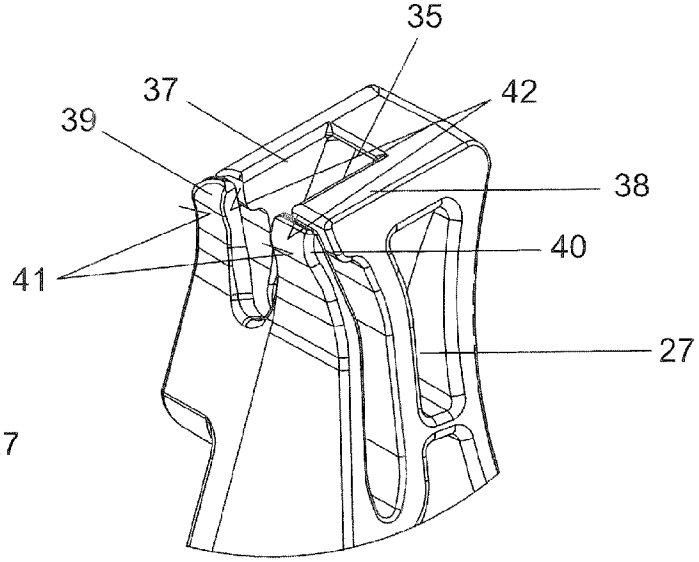
FIG. 35 shows an enlarged detail J from FIG. 32.
Figure 32:
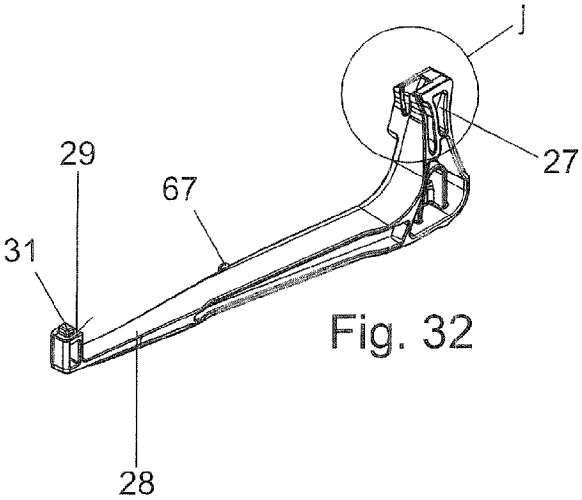
Figure 33:
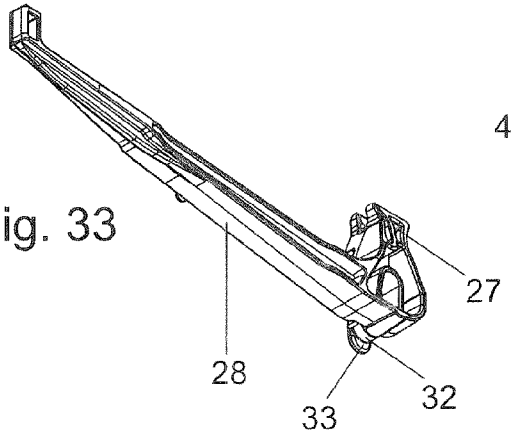

If one looks, as seen in a side view in the direction of the pivot axis 26, at a first straight connecting line 44, which extends between the stop surface 41 of the first lever arm 27 and the pivot axis 26, and a second straight connecting line 45, which extends between the supporting surface 29 of the second lever arm 28 and the pivot axis 26, then these two straight connecting lines 44, 45 enclose an angle 46 of less than 135°, preferably of less than 110°, cf. FIG. 23. This angle 46 preferably ranges from 70° to 100°.

The geometrical moment of inertia or area moment of inertia of the second lever arm 28 in relation to flexing at right angles to the longitudinal extent of the second lever arm 28 at the relevant location and at right angles to the pivot axis 26 decreases as the distance from the pivot axis 26 as measured along the course of the longitudinal extent of the second lever arm 28 increases. The geometrical moment of inertia preferably decreases continuously, at least over a predominant part of the length of the second lever arm 28. It is possible here for the second lever arm 28 to act like a leaf spring of parabolic configuration or like a support with the same degree of stressing.

In order to achieve this decrease in the geometrical moment of inertia, the exemplary embodiment provides for a corresponding decrease in the cross-sectional surface area of the second lever arm 28.

The displacement of the pull-out guide rail 5 in relation to the central guide rail 4 in the pulling-out displacement direction 6 is damped by means of a front stop damper 47, against which a mating stop element 48, which is arranged on the pull-out guide rail 5, runs up. The function is largely analogous to that of the interaction of the mating stop element 48, which is arranged on the basic-structure-mounted guide rail 3, with the rear stop damper 25, as described above. The above description thus also applies to the front stop damper 47 and the interaction thereof with the mating stop element 48, unless contrasts are made with this description hereinbelow.

The mating stop element 48 here is arranged on the pull-out guide rail 5, which is moved relative to the central guide rail 4 in the displacement direction 6, and the front stop damper 47, which is designed in the form of a two-armed lever, is mounted for pivoting about the pivot axis 49 on the central guide rail 4. For this purpose, an arcuate lower periphery of the front stop damper 47 rests on the lower horizontal crosspiece 22 of the central guide rail 4. A hook-like extension 50 of the front stop damper 47 extends through a through-passage in the lower horizontal crosspiece 22 of the central guide rail 4 and is thus fitted into the lower horizontal crosspiece 21. In a manner analogous to the stop lugs 39, 40 of the first lever arm 27 of the rear stop damper 25, the first lever arm 51 has a (in this case just a single) stop lug 52, of which the function corresponds to that of the stop lugs 39, 40 and which has the stop surface 54 for the mating stop element 48. The second lever arm 55 has, at its end, a hook-like extension 56, which extends through a through-passage in the lower horizontal crosspiece 21 and is thus fitted into the lower horizontal crosspiece 21. On its side which is directed toward the lower horizontal crosspiece 21, the extension 56 has a supporting surface 57 by which the second lever arm 55 is supported on the underside of the lower horizontal crosspiece 21.

FIGS. 7 to 13 show the pull-out guide rail 5 in the position in which, when the pull-out guide rail 5 is being pulled out in the displacement direction 6, the mating stop element 48 is just running up against the supporting surface 57. Any further movement in the displacement direction 6, during which the braking action of the pull-out guide rail 5 takes place, results in the first instance essentially in the bending of the stop lug 52, until the latter is butting against the basic part of the first lever arm 51. This results in the first lever arm 51 pivoting, the second lever arm 55 flexing in the process. The flexing of the second lever arm 55 is indicated schematically by a dashed line 53 in FIG. 13.

The overload-stop device here is formed by a first overload-stop element 58, which is arranged on the central guide rail 4, and a second overload-stop element 59, which is arranged on the pull-out guide rail 5. In the exemplary embodiment, the overload-stop elements 58, 59 are formed by tabs which are punched out of the profiles of the rails and bent in the outward direction. The first overload-stop element 58 projects horizontally from the lower end of the central guide rail 4. The second overload-stop element 59 projects downward from the underside of the supporting crosspiece 14 of the pull-out guide rail 5.

In that position of the pull-out guide rail 5 which is illustrated in FIGS. 7 to 13, and in which the mating stop element 48 is just running up against the stop surface 54 of the first lever arm 51 of the front stop damper 47, the overload-stop elements 58, 59 are spaced apart from one another by a distance b, cf. FIG. 9. If, when the pull-out guide rail 5 is being braked and the first lever arm 51 is being pivoted to an increasing extent, a limit value for this pivoting action of the lever arm 51 about the pivot axis 49 is reached, the second overload-stop element 59 stops against the first overload-stop element 58. Any further displacement of the pull-out guide rail 5 in relation to the central guide rail 4 in the displacement direction 6 is thus blocked, and therefore the pivoting action of the first lever arm 51 is blocked at the limit value, and thus the force to which the second lever arm 55 is subjected by the mating stop element 48 and also the flexing of the second lever arm 55 are limited.

In order to facilitate the installation of the front stop damper 47, an installation arm 69 is provided in the exemplary embodiment. During installation, the hook-like extension 50 is fitted into the through-passage in the lower horizontal crosspiece 21 and the hook-like extension 56, which is arranged at the end of the second lever arm 55, is fitted into the further through-passage in the lower horizontal crosspiece 21. For this purpose, the second lever arm 55 is flexed to some extent in the direction away from the vertical crosspiece 20, in order to guide the hook-like extension 56 through a widened region of said through-passage of the lower horizontal crosspiece 21, whereupon the second lever arm 55 is freed and the extension thus passes into a narrower region, in which it is no longer possible for the hook-like extension 56 to be pulled out of said through-passage.

The action of pushing together the pull-out guide results, in the position which is illustrated in FIGS. 1 to 6, in a further mating stop element 60, which is arranged on the pull-out guide rail 5, running up against a further stop surface 61 of the first lever arm 51 of the front stop damper 47. This stop surface 61 is located opposite the stop surface 54, i.e. the stop surface 54 is directed in the pushing-in displacement direction 7 and the stop surface 61 is directed in the pulling-out displacement direction 6. The stop surface 61 here is arranged directly on the basic part of the first lever arm 51. However, it should also be conceivable and possible, in principle, to provide, on this side of the first lever arm, at least one stop lug which is capable of bending, is spaced apart from the basic part of the first lever arm 51 via a slot, in a manner analogous to the stop lug 52, and has the stop surface 61.

FIGS. 1 to 6 show precisely the position in which the mating stop element 60 comes into abutment against the stop surface 61. During further displacement of the pull-out guide rail 5 in the pushing-in displacement direction 7, the first lever arm 51 is pivoted about the pivot axis 49 by the mating stop element 60, to be precise in the opposite pivoting direction to that when the first lever arm 51 is pivoted by the mating stop element 48 during the braking action of the pull-out guide rail 5 at the end of the pull-out distance. The second lever arm 55, which is then supported on the lower horizontal crosspiece 21 of the central guide rail 4 by way of a supporting surface 62, which butts against the upper side of the lower horizontal crosspiece 21, is thus flexed. The flexing of the second lever arm 55 is indicated by a dashed line 66 in FIG. 5. The flexing illustrated, however, has been exaggerated for reasons of clarity. In actual fact, after even a relatively small amount of flexing, the second lever arm 55 ends up in abutment, in a central region of its longitudinal extent, against the upper side of the lower horizontal crosspiece 21. Any further pivoting of the first lever arm 51 results in flexing of the second lever arm 55 in the region between this location of abutment, in the central region of its longitudinal extent, against the lower horizontal crosspiece 21 of the central guide rail 4 and the pivot axis 49. The spring rate thus increases considerably in relation to the flexing before the central region of the longitudinal extent of the second lever arm 55 comes into abutment against the lower horizontal crosspiece 21.

An overload-stop device is provided, once again, to limit the pivoting action of the first lever arm 51 about the pivot axis 49. In the exemplary embodiment, said overload-stop device comprises the first overload-stop element 58, which is arranged on the central guide rail 4, and a third overload-stop element 63, which is arranged on the pull-out guide rail 5. In the exemplary embodiment shown, the third overload-stop element 63 is formed by a tab which is punched out of the profile of the guide rail and bent in the outward direction. This tab extends downward from the supporting crosspiece 14.

Figure 1:
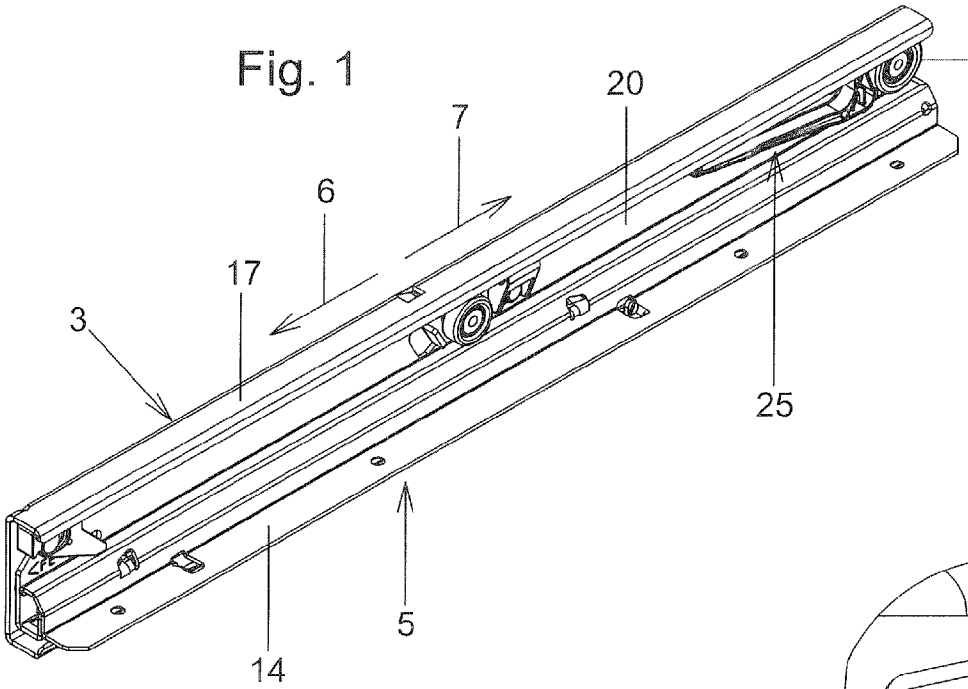
FIG. 1 shows a perspective view of one exemplary embodiment of the invention of a pull-out guide in the pushed-together state.
Figure 4:
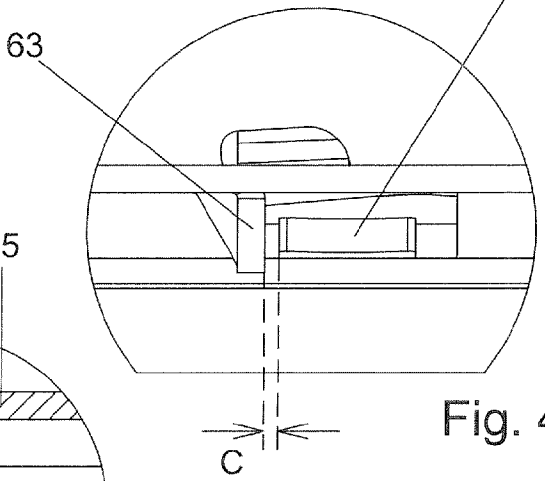
FIG. 4 shows an enlarged detail A from FIG. 2.
Figure 6:
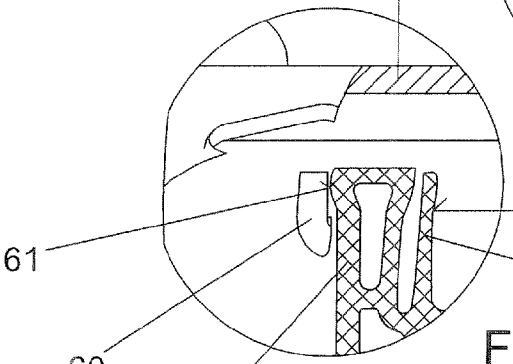
FIG. 6 shows an enlarged detail C from FIG. 5.
Figure 2:
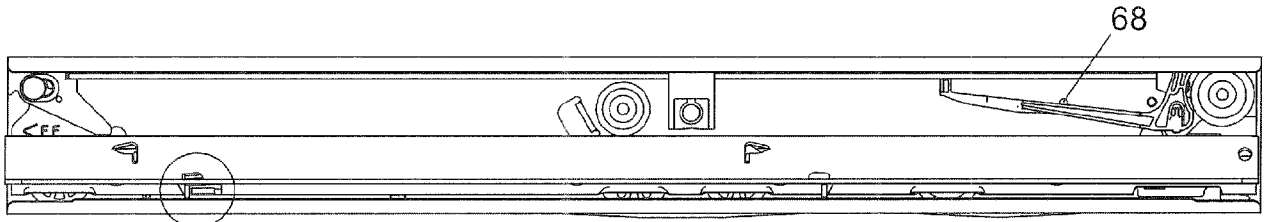
FIG. 2 shows an elevation view of the pull-out guide.
Figure 3:
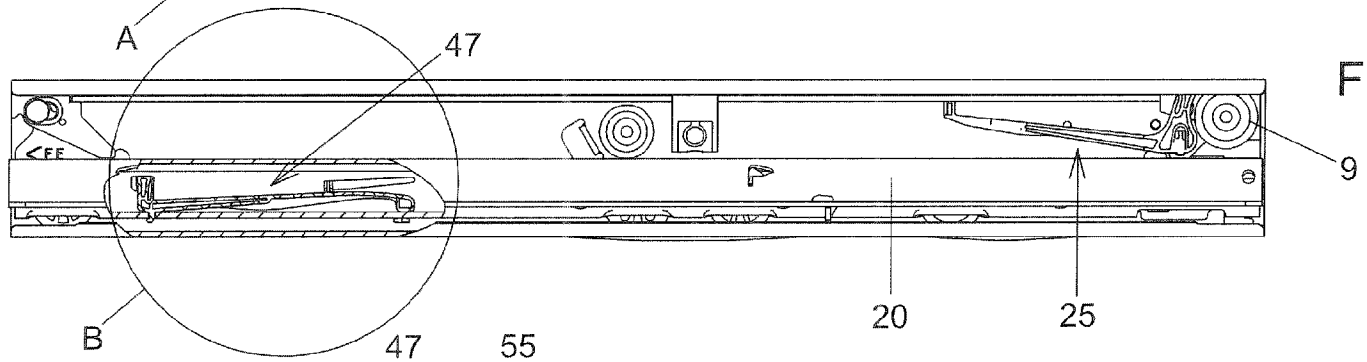
FIG. 3 shows an elevation view corresponding to FIG. 2, illustrating the rails in a partially broken-away state in the region of the front stop dampers.
Figure 5:
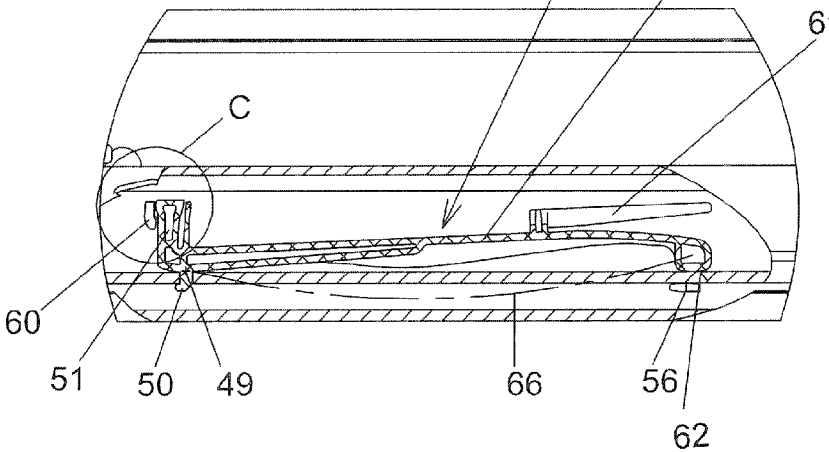
FIG. 5 shows an enlarged detail B from FIG. 3.

In a position which is illustrated in FIGS. 1 to 6, the third overload-stop element 63 is spaced apart from the first overload-stop element 58 by a distance c, cf. FIG. 4. During further displacement of the pull-out guide rail 5 in the displacement direction 7, wherein the first lever arm 51 is pivoted about the pivot axis 49, the third overload-stop element 63 advances up to the first overload-stop element 58 until it comes into abutment against the same. Any further displacement of the pull-out guide rail 5 in relation to the central guide rail 4 in the displacement direction 7 is thus blocked, and therefore pivoting action of the first lever arm 51 is restricted to a limit value and thus the force to which the second lever arm 55 is subjected by the mating stop element 60 is limited.

In the exemplary embodiment shown, the action of pushing the central guide rail 4 into the basic-structure-mounted guide rail 3 is limited by a fixed stop between the stop part 64 of the basic-structure-mounted guide rail 3 and an end stop 65 of the central guide rail 4. The stop part 64 is formed by a tab which is punched out of the connecting crosspiece 16 and bent in the outward direction, and the end stop 65 is formed by a rear end surface of the vertical crosspiece 20 of the central guide rail 4.

It should also be possible to provide, for the action of pushing the central guide rail 4 into the basic-structure-mounted guide rail 3, a stop damper for braking the central guide 4 at the end of the displacement distance. This stop damper to be designed, once again, in the manner of the stop damper 25 or 47.

It is also conceivable and possible, however, for the rear stop damper 25 to have its second lever arm 28 running rearward instead of forward (from the pivot axis 26 to the free end of the lever arm). The rear stop damper 25 would then have to be arranged, in the pivotable manner, further forward on the central guide rail. Angle and function are identical, but the supporting surface is then subjected to tensile, rather than compressive, loading. It would be possible for this purpose, in a manner analogous to the exemplary embodiment shown for the front stop damper 47, for the second lever arm 28 to have, at the end, a hook, by way of which it interacts with the central guide rail 4.

A contact location which can be subjected to tensile loading could also be designed in some other way.

It would also be possible for the front stop damper 47 to be designed, and mounted in a pivotable manner, such that its second lever arm 55 extends forward.

It would also be possible, in the case of the rear and/or front stop damper 25, 47, for the first lever arm 27 or 51, respectively, to extend downward instead of upward. The mating stop element would have to be arranged correspondingly.

It is also conceivable and possible to have exemplary embodiments in which just one rear stop damper 25 designed in the manner described, or just one front stop damper 47 designed in the manner described, is present.

For the purpose of damping between the central guide rail and the basic-structure-mounted guide rail, it would also be possible to provide a stop damper designed in a manner corresponding to the front stop damper 47. Conversely, for the purpose of damping between the central guide rail and the pull-out guide rail, it would also be possible to provide a stop damper designed in a manner corresponding to the rear stop damper 25.

The invention, of course, can also be used for pull-out guides which have merely two guide rails which can be displaced in relation to one another or which have more than three guide rails which can be displaced in relation to one another.

| Key to reference signs: | |
|---|---|
| 1 | pull-out furniture part |
| 2 | basic furniture structure |
| 3 | basic-structure-mounted guide rail |
| 4 | central guide rail |
| 5 | pull-out guide rail |
| 6 | displacement direction |
| 7 | displacement direction |
| 8 | front running roller |
| 9 | rear running roller |
| 10 | central running roller |
| 11 | differential roller |
| 12 | supporting roller |
| 13 | auxiliary roller |
| 14 | supporting crosspiece |
| 15 | running crosspiece |
| 16 | connecting crosspiece |
| 17 | upper running crosspiece |
| 18 | lower running crosspiece |
| 19 | connecting crosspiece |
| 20 | vertical crosspiece |

-continued

| Key to reference signs: | |
|---|---|
| 21 | lower horizontal crosspiece |
| 22 | flange |
| 23 | upper horizontal crosspiece |
| 24 | mating stop element |
| 25 | rear stop damper |
| 26 | pivot axis |
| 27 | first lever arm |
| 28 | second lever arm |
| 29 | supporting surface |
| 30 | through-passage |
| 31 | stub |
| 32 | axial stub |
| 33 | protrusion |
| 34 | opening |
| 35 | opening |
| 36 | end stop |
| 37 | side limb |
| 38 | side limb |
| 39 | stop lug |
| 40 | stop lug |
| 41 | stop surface |
| 42 | abutment surface |
| 43 | line |
| 44 | first straight connecting line |
| 45 | second straight connecting line |
| 46 | angle |
| 47 | front stop damper |
| 48 | mating stop element |
| 49 | pivot axis |
| 50 | extension |
| 51 | first lever arm |
| 52 | stop lug |
| 53 | line |
| 54 | stop surface |
| 55 | second lever arm |
| 56 | extension |
| 57 | supporting surface |
| 58 | overload-stop element |
| 59 | overload-stop element |
| 60 | mating stop element |
| 61 | stop surface |
| 62 | supporting surface |
| 63 | overload-stop element |
| 64 | stop part |
| 65 | end stop |
| 66 | line |
| 67 | stub |
| 68 | slot |
| 69 | installation arm |

The invention claimed is:

1. A pull-out guide for a furniture part which can be pulled out of a basic furniture structure, the pull-out guide comprising a first guide rail and a second guide rail mounted displaceably to move over a displacement distance, in and counter to a displacement direction, in relation to the first guide rail, a stop damper that damps a braking action of the second guide rail at least at one end of the displacement distance, the stop damper arranged on one of the guide rails, a mating stop element arranged on the other guide rail and the mating stop element runs up against the stop damper, wherein the stop damper comprises a lever pivotably mounted about a pivot axis on the guide rail on which the stop damper is arranged, and includes a first lever arm with a stop surface, against which the mating stop element runs up during the braking action of the second guide rail, and a second lever arm, which flexes elastically for damping the braking action of the second guide rail and has a supporting surface by which the second lever arm is supported in relation to the guide rail on which the stop damper is mounted in a pivotable manner, and an overload-stop device that takes effect at a limit value for the pivoting action of the first lever arm about the pivot axis, and limits a pivoting action of the first lever arm about the pivot axis, and the stop surface of the first lever arm, solely as a result of the flexing of the second lever arm, is movable over a distance of at least 1 mm before the overload-stop device takes effect.

2. The pull-out guide as claimed in claim 1, wherein the second lever arm, at least over part of a longitudinal extent thereof, is oriented at an angle of less than 45° to the displacement direction.

3. The pull-out guide as claimed in claim 1, wherein a length of the second lever arm as measured along a course of a longitudinal extent of the second lever arm from the pivot axis to the supporting surface is at least three times a length of the first lever arm as measured along a course of the longitudinal extent of the first lever arm from the pivot axis to the stop surface.

4. The pull-out guide as claimed in claim 3, wherein, as seen in a side view in a direction of the pivot axis, a first straight connecting line, which runs between the stop surface of the first lever arm and the pivot axis, encloses an angle of less than 135° with a second straight connecting line, which runs between the supporting surface of the second lever arm and the pivot axis.

5. The pull-out guide as claimed in claim 3, wherein, as seen in a side view in a direction of the pivot axis, a first straight connecting line, which runs between the stop surface of the first lever arm and the pivot axis, encloses an angle of less than 110° with a second straight connecting line, which runs between the supporting surface of the second lever arm and the pivot axis.

6. The pull-out guide as claimed in claim 1, wherein the first lever arm has a basic part extending over a length of the first lever arm, and a spring rate of flexing of the second lever arm is less than 10% of a spring rate of flexing of a basic part of the first lever arm.

7. The pull-out guide as claimed in claim 1, wherein an area moment of inertia which acts in relation to flexing at right angles to a longitudinal extent of the second lever arm at a relevant location of the second lever arm and at right angles to the pivot axis decreases as a distance from the pivot axis as measured along a course of the longitudinal extent of the second lever arm increases.

8. The pull-out guide as claimed in claim 1, wherein the stop damper has a main material which is a plastics material which has a modulus of elasticity which ranges from 6,000 to 30,000.

9. The pull-out guide as claimed in claim 8, wherein the stop damper is in one piece and consists of the main material.

10. The pull-out guide as claimed in claim 1, wherein at least one of the guide rails is provided with rollers which are rotatably mounted on pins which are fixed in location in relation to the guide rail.

11. The pull-out guide as claimed in claim 1, wherein the stop surface of the first lever arm, solely as a result of the flexing of the second lever arm, is movable over a distance of at least 2 mm before the overload-stop device takes effect.

12. The pull-out guide as claimed in claim 1, wherein the stop damper has a main material which is a plastics material which has a modulus of elasticity which ranges from 10,000 to 25,000.

13. A pull-out guide for a furniture part which can be pulled out of a basic furniture structure, the pull-out guide comprising a first guide rail and a second guide rail mounted displaceably to move over a displacement distance, in and counter to a displacement direction, in relation to the first guide rail, a stop damper that damps a braking action of the second guide rail at least at one end of the displacement distance, the stop damper arranged on one of the guide rails, a mating stop element arranged on the other guide rail and the mating stop element runs up against the stop damper, wherein the stop damper comprises a lever pivotably mounted about a pivot axis on the guide rail on which the stop damper is arranged, and includes a first lever arm with a stop surface, against which the mating stop element runs up during the braking action of the second guide rail, and a second lever arm, which flexes elastically for damping the braking action of the second guide rail and has a supporting surface by which the second lever arm is supported in relation to the guide rail on which the stop damper is mounted in a pivotable manner, and an overload-stop device that takes effect at a limit value for the pivoting action of the first lever arm about the pivot axis, and limits a pivoting action of the first lever arm about the pivot axis, and the overload-stop device comprises the mating stop element and an end stop, which is arranged on the guide rail on which the stop damper is mounted in a pivotable manner, and against which the mating stop element runs up when the limit value for the pivoting action of the first lever arm about the pivot axis is reached.

14. The pull-out guide as claimed in claim 13, wherein the end stop is arranged between two side limbs of the first lever arm.

15. A pull-out guide for a furniture part which can be pulled out of a basic furniture structure, the pull-out guide comprising a first guide rail and a second guide rail mounted displaceably to move over a displacement distance, in and counter to a displacement direction, in relation to the first guide rail, a stop damper that damps a braking action of the second guide rail at least at one end of the displacement distance, the stop damper arranged on one of the guide rails, a mating stop element arranged on the other guide rail and the mating stop element runs up against the stop damper, wherein the stop damper comprises a lever pivotably mounted about a pivot axis on the guide rail on which the stop damper is arranged, and includes a first lever arm with a stop surface, against which the mating stop element runs up during the braking action of the second guide rail, and a second lever arm, which flexes elastically for damping the braking action of the second guide rail and has a supporting surface by which the second lever arm is supported in relation to the guide rail on which the stop damper is mounted in a pivotable manner, and an overload-stop device that takes effect at a limit value for the pivoting action of the first lever arm about the pivot axis, and limits a pivoting action of the first lever arm about the pivot axis, and the overload-stop device comprises a first stop element, which is arranged on the first guide rail, and a second overload-stop element, which is arranged on the second guide rail and against which the first overload-stop element runs up when the limit value for the pivoting action of the first lever arm about the pivot axis is reached.

16. A pull-out guide for a furniture part which can be pulled out of a basic furniture structure, the pull-out guide comprising a first guide rail and a second guide rail mounted displaceably to move over a displacement distance, in and counter to a displacement direction, in relation to the first guide rail, a stop damper that damps a braking action of the second guide rail at least at one end of the displacement distance, the stop damper arranged on one of the guide rails, a mating stop element arranged on the other guide rail and the mating stop element runs up against the stop damper, wherein the stop damper comprises a lever pivotably mounted about a pivot axis on the guide rail on which the stop damper is arranged, and includes a first lever arm with a stop surface, against which the mating stop element runs up during the braking action of the second guide rail, and a second lever arm, which flexes elastically for damping the braking action of the second guide rail and has a supporting surface by which the second lever arm is supported in relation to the guide rail on which the stop damper is mounted in a pivotable manner, and an overload-stop device that takes effect at a limit value for the pivoting action of the first lever arm about the pivot axis, and limits a pivoting action of the first lever arm about the pivot axis, and the first lever arm has at least one stop lug, wherein the at least one stop lug includes the stop surface and is elastically flexible when the mating stop element runs up against the stop surface and, when the at least one stop lug reaches a maximum flexing value, the at least one stop lug positions itself against a supporting surface of the first lever arm.

17. The pull-out guide as claimed in claim 16, wherein a spring rate of flexing of the at least one stop lug is less than 10% of a spring rate of flexing of the second lever arm.

* * * * *